United States Patent [19]

Grunbaum

[11] 3,958,434

[45] May 25, 1976

[54] WASHING MACHINE

[75] Inventor: Peter Grünbaum, Graz, Austria

[73] Assignee: Binder and Co., Aktiengesellschaft, Gleisdorf, Austria

[22] Filed: Aug. 1, 1974

[21] Appl. No.: 493,694

[30] Foreign Application Priority Data

Aug. 2, 1973 Austria ..... 6788/73

[52] U.S. Cl. ..... 68/27; 68/28; 68/172; 68/210; 259/54; 51/163.1

[51] Int. Cl.² ..... D06F 27/00; D06F 31/00; D06F 37/30

[58] Field of Search ..... 68/27, 28, 62, 152–156, 68/171–174, 210; 259/2, 12, 13, 17, 29, 35, 54, 56, 59, 72, 75, 91; 51/7, 163

[56] References Cited

UNITED STATES PATENTS

| | | | |
|---|---|---|---|
| 242,163 | 5/1881 | Skinner | 68/173 X |
| 2,680,084 | 6/1954 | Ryan | 68/171 X |
| 3,502,273 | 3/1970 | West et al. | 259/54 X |

FOREIGN PATENTS OR APPLICATIONS

| | | | |
|---|---|---|---|
| 532,782 | 11/1954 | Belgium | 259/72 |

*Primary Examiner*—Peter Feldman
*Assistant Examiner*—Philip R. Coe
*Attorney, Agent, or Firm*—Kurt Kelman

[57] ABSTRACT

A washing machine comprises two frames each mounting a plurality of tubular wash receptacles and arranged to oscillate on a support in opposite directions. Connecting rods resiliently affixed to each frame interconnect the two frames and constitute an oscillating system with the frame and receptacles mounted thereon. A crank drive oscillates the system in the range of the natural frequency thereof. Wash and wash liquid is preferably continuously delivered to each receptacle.

7 Claims, 2 Drawing Figures

WASHING MACHINE

The present invention relates to improvements in washing machines of the type wherein a wash receptacle is mounted on a frame and resiliently carried by a support, a drive oscillating the frame and receptacle, and wash and washing liquid being preferably continuously deliverable to the wash receptacle.

One known embodiment of this type of washing machine has two tubular wash receptacles one end of which has a wash delivery chute affixed thereto while the other end thereof has an adjustable outlet gate. The two tubular wash receptacles are mounted parallel to each other and are interconnected by link rods to a metal casing, with damper springs interposed. The oscillating drive for the resiliently mounted wash receptacles is arranged in a third tube which is fixedly connected with the support for the wash receptacles.

This type of oscillating washer requires a relatively large amount of operating energy and the oscillations of the wash receptacles is limited to a circular path and a relatively small oscillating amplitude.

It is a primary object of this invention to overcome these disadvantages of oscillating washers.

This and other objects are accomplished in accordance with the invention with a washing machine which comprises a support, two masses carried by the support and arranged to oscillate thereon in opposite directions, at least one of the oscillating masses comprising a frame and a wash receptacle mounted on the frame for oscillation therewith, and means for carrying the two masses on the support. Resilient means interconnect the two masses, the two masses and the interconnecting resilient means constituting an oscillating system. A drive is mounted on the support for oscillating the system in the range of the natural frequency thereof or in harmonic motion. Means for delivering wash and washing liquid, preferably continuously, to the receptacle is also provided.

In the preferred embodiment herein described and illustrated, the means for carrying the two masses on the support comprises a pivot axle mounted on the support and a guide rod pivotally mounted on the axle and interconnecting the two masses, and the drive is a crank drive.

I have found energy savings up to 60% in the washing machine of the present invention as compared to that of the prior art first hereinabove described. Furthermore, the oscillating system of this invention readily provides an almost linear or slightly arcuate oscillating path of relatively large amplitude.

Figure 1:
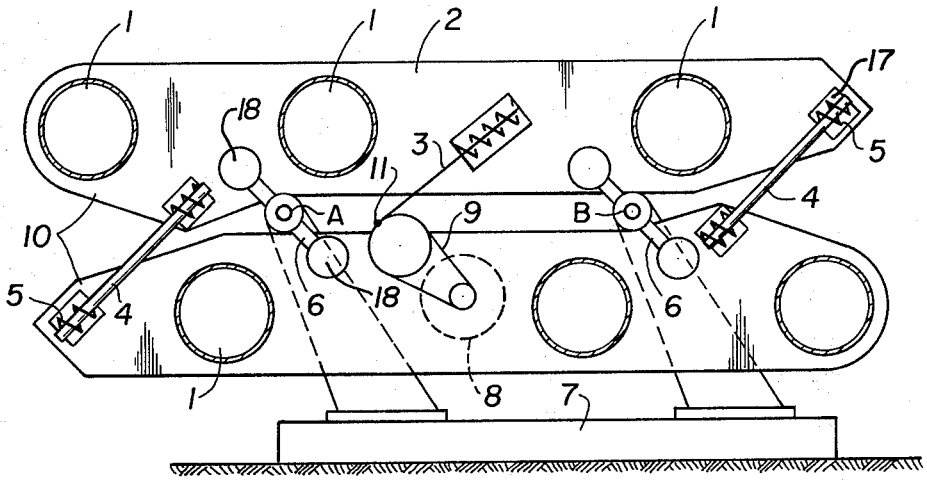
Figure 2:
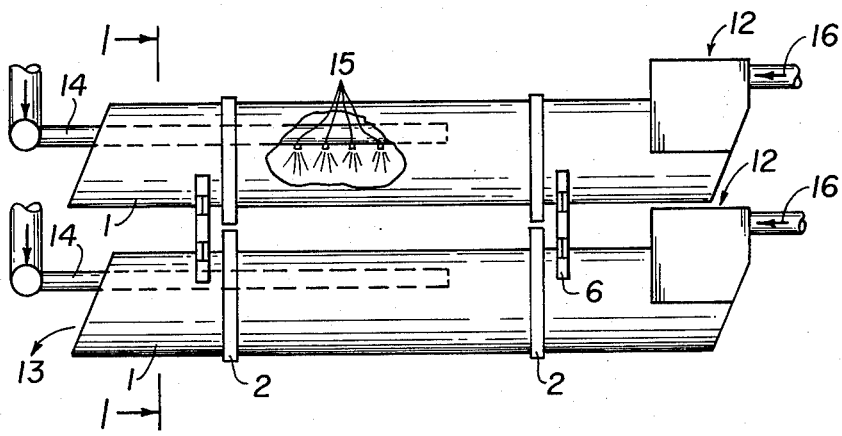

The above and other objects, advantages and features of this invention will become more apparent from the following detailed description of a now preferred embodiment thereof, taken in conjunction with the accompanying drawing wherein FIG. 1 is a schematic vertical section along line I—I of FIG. 2, with the delivery means for the wash and washing liquid removed to focus on the oscillating system, and FIG. 2 is a side elevational view of the washing machine.

Referring now to the drawing, the wash receptacles are shown to consist of tubes 1 mounted on frames 2. As shown, an upper row of tubular wash receptacles 1 is fixedly held in a pair of aligned upper frames, and a lower row of tubular wash receptacles is fixedly held in a pair of lower frames, the pairs of frames with their affixed wash receptacles forming two masses 10 carried by support 7 and arranged to oscillate thereon in opposite directions. The means for carrying the two masses 10 on support 7 comprises horizontal pivot axles A and B journaled in support 7 and respective guide rods 6 whose ends are respectively connected to stub shafts 18 projecting from the upper and lower frames 2 and which are pivotal on the axles and interconnect the masses 10. Depending on the selected radius of the guide rods, which equidistantly extend from their pivot axle to the connecting points on frames 2, each point of the tubular wash receptacles of the two masses will oscillate in opposite directions in an arcuate to almost linear path.

Resilient means interconnect the two masses 10 to constitute an oscillating system therewith, the illustrated resilient means comprising connecting rods 4 resiliently connected to the upper and lower frame by means of springs 5. The springs are held in mounting brackets 17 affixed to the frames, one end of each spring being connected to a respective end of each rod 4 while its other end bears against bracket 17. The springs may be metallic or plastic. Resiliently connected rods 4 with their springs 5 constitute support and return elements of the oscillating system which has a natural frequency or harmonic motion. This natural frequency may be determined by the dimensioning and arrangement of the two masses 10 and/or of the support and return elements of the system.

To initiate and maintain the oscillations of masses 10 in opposite directions, crank drive 3 is arranged substantially parallel to connecting rods 4 to oscillate the system in the range of the natural frequency thereof or in harmonic motion. The crank of the drive is journaled in lower frame 2 while the end of the drive shaft is affixed resiliently to the upper frame 2 in a manner similar to the resilient connection of connecting rods 4 to the frames. Motor 8 is mounted on support 7 and drives the crank by means of belt drive 9. Adjustment of crank pin 11 will change the stroke of the drive. Such an adjustment and/or changing of springs 5 to adjust the resiliency of the mounting will produce a change in the oscillating amplitude of the system.

This adjustability is of considerable advantage because a specific oscillating amplitude is required for best results in connecting with different types of wash. This amplitude is preferably up to 40 mm.

The washing machine illustrated in the drawing is arranged for continuous operation, each tubular wash receptacle having a wash delivery chute 12 at one end, a wash water delivery pipe 16 being attached to this end so that wash and wash water may be continuously supplied to the receptacle, if desired. An outlet gate 13 is mounted at the other end of each receptacle to enable the washed goods to be removed therefrom, the receptacle being preferably inclined from the horizontal to control the residence time of the wash in the receptacle as it passes from the inlet to the outlet end thereof. Rinsing water may by supplied to the receptacles by pipes 14 entering through the outlet end thereof, the water being sprayed on the wash by nozzles 15.

What is claimed is:

1. A washing machine comprising 1. a support,
2. two masses carried by the support and arranged to oscillate thereon in opposite directions, a. each of the oscillating masses comprising a frame and a plurality of tubular wash receptacles mounted on the frame for oscillation therewith, 3. means for carrying the two masses on the support, 4. resilient means interconnecting the two masses, a. the two masses and the interconnecting resilient means constituting an oscillating system, 5. a drive for oscillating the system in the range of the natural frequency thereof, 6. means for delivering wash to the receptacle, and 7. pipes for delivering washing liquid leading into each of the receptacles

2. The washing machine of claim 1, wherein the means for carrying the two masses on the support comprises a pivot axle mounted on the support and a guide rod pivotally mounted on the axle and interconnecting the two masses.

3. The washing machine of claim 1, wherein the resilient means comprises connecting rods resiliently connected to each of the masses.

4. The washing machine of claim 1, wherein the drive comprises a crank drive.

5. The washing machine of claim 4, wherein the stroke of the crank drive is adjustable.

6. The washing machine of claim 1, wherein the resiliency of the resilient means is adjustable.

7. The washing machine of claim 1, wherein the amplitude of the oscillation of the oscillating system is up to 40 mm.

* * * * *